US007391330B1

(12) United States Patent
Brown

(10) Patent No.: US 7,391,330 B1
(45) Date of Patent: Jun. 24, 2008

(54) REMOTE CONTROLLED AWAKENING DEVICE

(76) Inventor: Angela Brown, 8050 W. McNab Rd., #120, Tamarac, FL (US) 33321

( * ) Notice: Subject to any disclaimer, the term of this patent is extended or adjusted under 35 U.S.C. 154(b) by 183 days.

(21) Appl. No.: 11/262,017

(22) Filed: Oct. 31, 2005

(51) Int. Cl.
*G08B 23/00* (2006.01)

(52) U.S. Cl. ..... 340/573.1; 340/539.1; 340/575; 340/7.6; 340/407.1

(58) Field of Classification Search ..... 340/573.1, 340/539.1, 539.11, 575, 573.7, 3.1, 7.6, 309.16, 340/407.1
See application file for complete search history.

(56) References Cited

U.S. PATENT DOCUMENTS 5,144,600 A 9/1992 Cheng
5,515,865 A * 5/1996 Scanlon ..... 600/534
5,684,460 A * 11/1997 Scanlon ..... 340/573.1
5,686,882 A 11/1997 Giani
D406,067 S 2/1999 Bouban
6,151,278 A * 11/2000 Najarian ..... 368/12
6,175,981 B1 1/2001 Lizama
6,502,264 B1 1/2003 Clothier et al.
7,170,397 B2 * 1/2007 Roby et al. ..... 340/407.1

* cited by examiner

*Primary Examiner*—Daryl C Pope

(57) ABSTRACT

A remote controlled vibratory and auditory awakening device comprising a plurality of parallelepiped pads, vibratory media within each pad, auditory emission mechanism communicating with each pad, a remote control in RF communication with every pad, whereby the variety of commands provided by the invention include choice of pad, choice of vibration or auditory emission or both, choice of intensity of vibration, volume of sound from auditory emission mechanisms, and audio input from the microphone of the remote control. The remote control also provides for duration of auditory and vibratory emissions.

11 Claims, 4 Drawing Sheets

REMOTE CONTROLLED AWAKENING DEVICE

BACKGROUND OF THE INVENTION

Awakening is not easy for everyone. Many individuals must be personally awakened, even if on a predetermined repetitive schedule. Personally waking an individual not only requires time and foot travel, but also is not always pleasant. What is needed is a remotely operated device for awakening a sleeping person and even several sleeping people, with a variety of choices in how to do so and in the intensity of the waking instrument employed. The present invention provides a unique device for accomplishing this.

FIELD OF THE INVENTION

The present invention relates to devices for waking sleeping persons and more especially to a remote controlled awakening device that can be used to wake more than one.

SUMMARY OF THE INVENTION

The general purpose of the remote controlled awakening device, described subsequently in greater detail, is to provide a remote controlled awakening device which has many novel features that result in an improved remote controlled awakening device which is not anticipated, rendered obvious, suggested, or even implied by prior art, either alone or in combination thereof.

To accomplish this, the remote controlled vibratory and auditory awakening device comprising a parallelepiped pad. The preferred example of the invention comprises a plurality of parallelepiped pads. A vibratory media is disposed within each pad. The vibratory media is preferably comprised of a plurality of vibrators. An auditory emission mechanism communicates with each pad. A remote control is in RF communication with every pad. The variety of commands provided by the invention include choice of pad, choice of vibration or auditory emission or both, choice of intensity of vibration, volume of sound from auditory emission mechanisms, and audio input from the microphone of the remote control. The remote control also provides for duration of auditory and vibratory emissions.

The invention provides for waking a person via the remote control, no matter where the operator, within a reasonable distance as defined by the current art of remote controlled devices. The remote wakening of individuals negates the need to personally travel to the sleeping person's side. The invention also provides the ability to auditorially communicate with each pad via the remote control. The invention is therefore highly portable.

Thus has been broadly outlined the more important features of the remote controlled awakening device so that the detailed description thereof that follows may be better understood and in order that the present contribution to the art may be better appreciated.

Numerous objects, features and advantages of the remote controlled awakening device will be readily apparent to those of ordinary skill in the art upon reading the following detailed description of presently preferred, but nonetheless illustrative, examples of the remote controlled awakening device when taken in conjunction with the accompanying drawings. In this respect, before explaining the current examples of the remote controlled awakening device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the remote controlled awakening device. It is therefore important that the claims be regarded as including such equivalent constructions insofar as they do not depart from the spirit and scope of the present invention.

Objects of the remote controlled awakening device, along with various novel features that characterize the invention are particularly pointed out in the claims forming a part of this disclosure. For better understanding of the remote controlled awakening device, its operating advantages and specific objects attained by its uses, refer to the accompanying drawings and description.

DETAILED DESCRIPTION OF THE DRAWINGS

With reference now to the drawings, and in particular FIGS. 1 through 5 thereof, example of the remote controlled awakening device employing the principles and concepts of the present invention and generally designated by the reference number 10 will be described.

Figure 1:
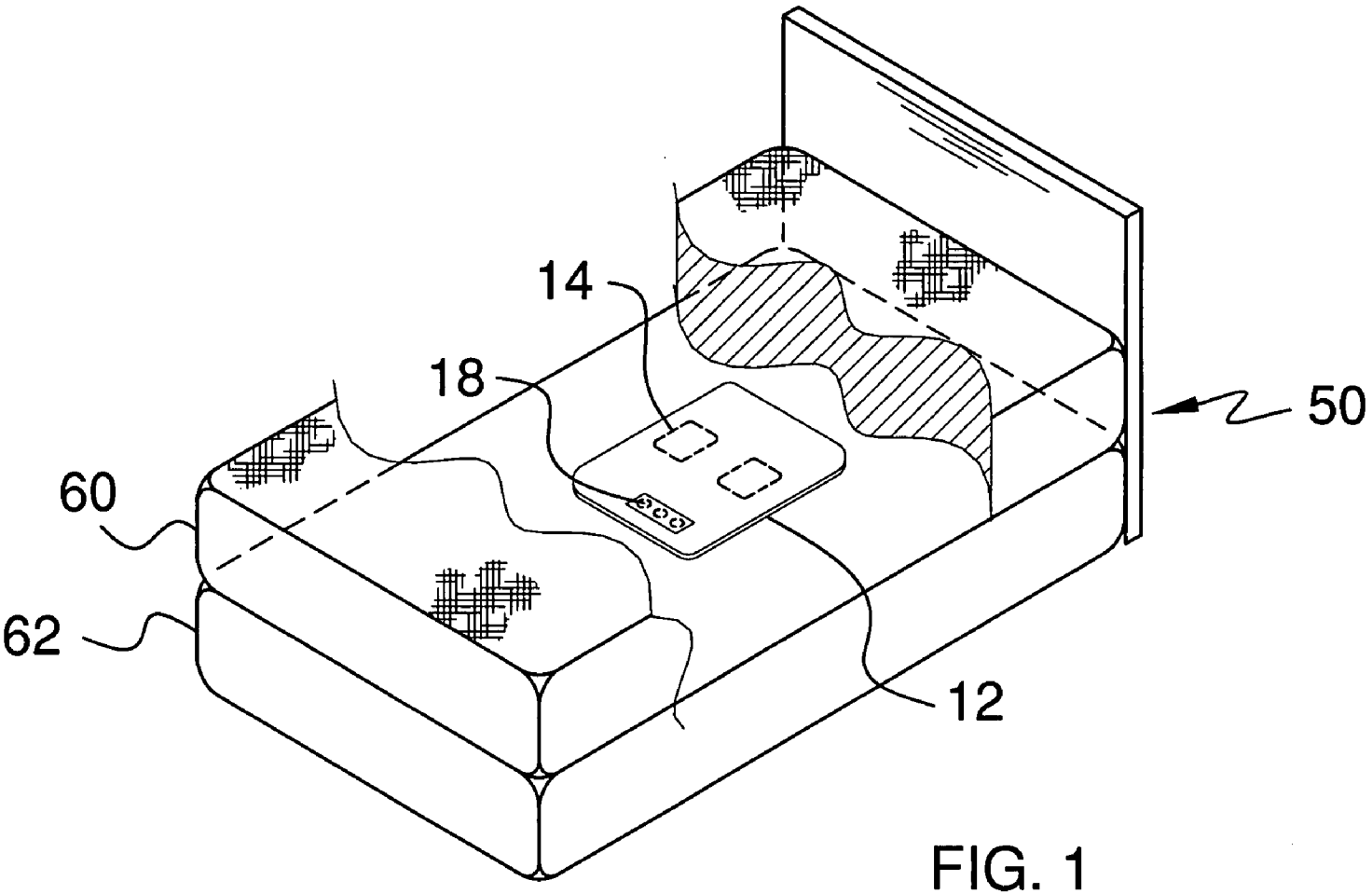
FIG. 1 is a perspective view of the pad of the invention installed between a mattress and a box spring of a bed.
Figure 2:
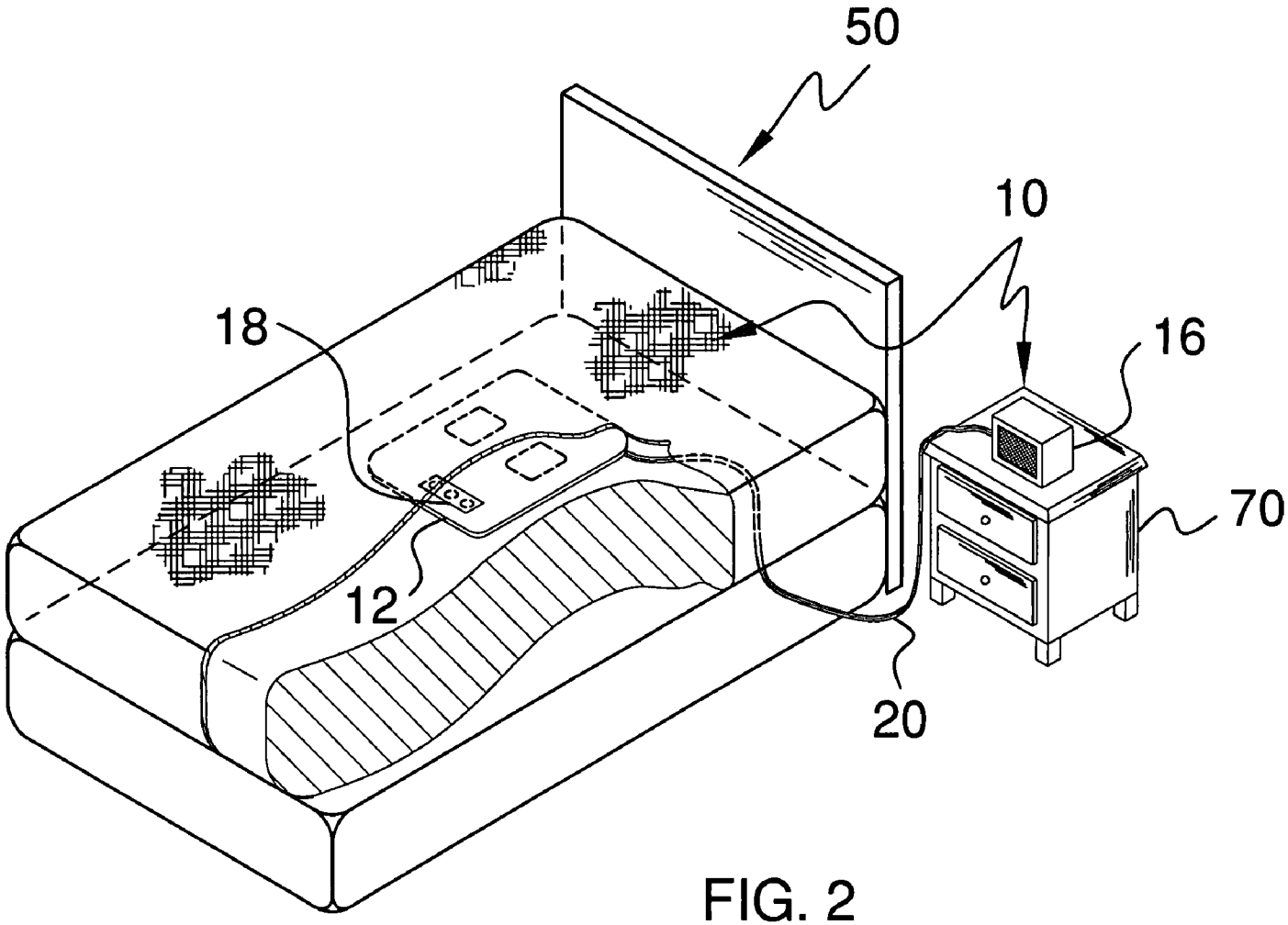
FIG. 2 is a perspective view of the invention installed within a bed, and the speaker of the invention upon a nightstand.
Figure 3:
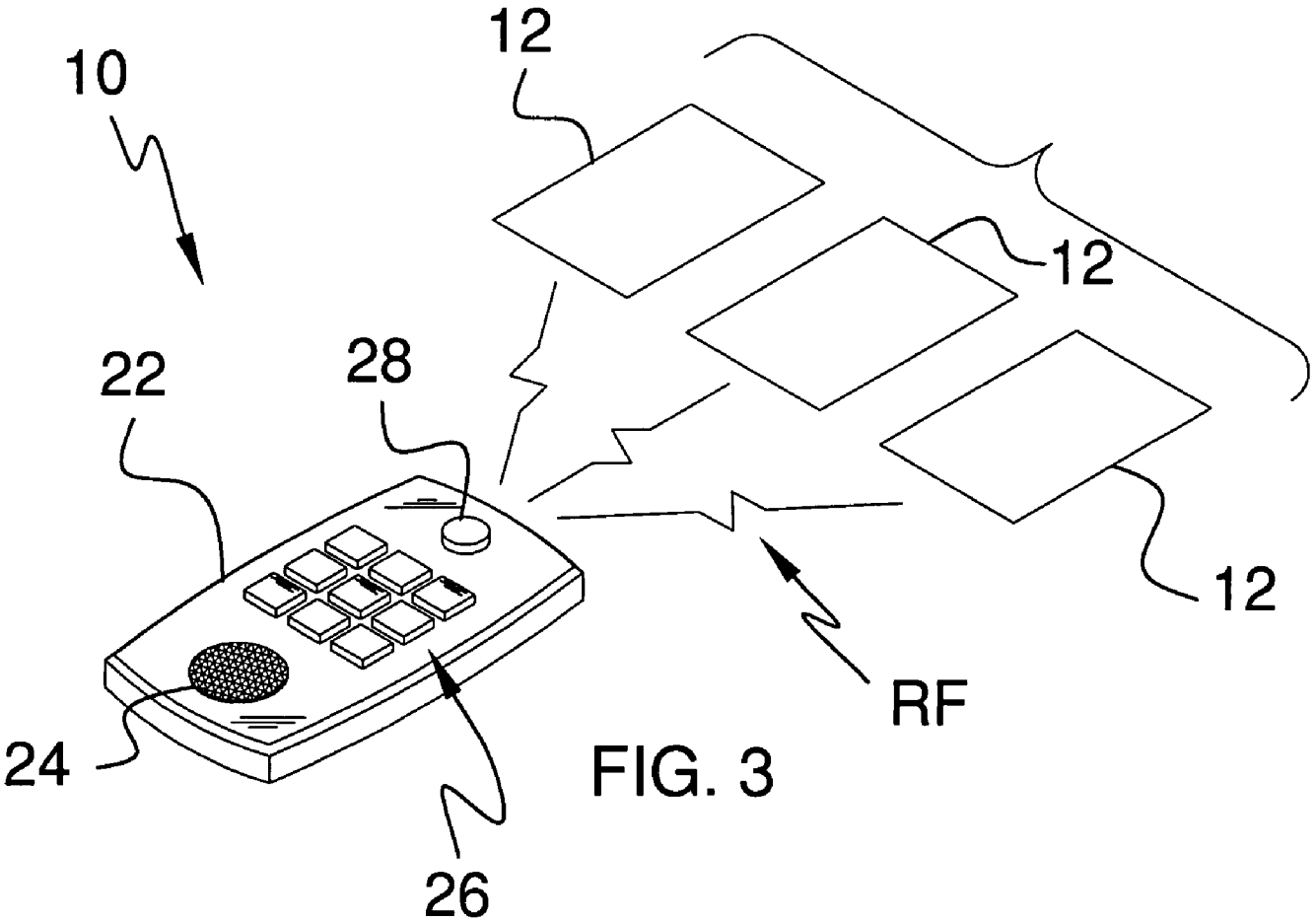
FIG. 3 is a perspective view of the remote control of the invention, illustrating the control of more than one pad.

Referring to FIGS. 1 and 2, the invention 10 comprises a remote controlled vibratory and auditory awakening device, in combination, the invention 10 further comprising a plurality of parallelepiped pads 12 (FIG. 3). Each pad 12 further comprises a parallelepiped shape, preferably substantially of a cushioning material. The vibratory media within each pad 12 is comprised of at least one vibrator 14. The preferred example of the pad 12 is comprised of a plurality of vibrators 14. Vibrators 14 are preferably substantially equidistant from each other. The preferred example of the invention 10 further comprises an auditory emission mechanism communicating with each pad 12. The emission mechanism is preferably comprised of at least one speaker 16. The speaker 16 is preferably remotely located from the pad 12 and is connected by wire 20 to the pad 12. The speaker 16 is conveniently located, by choice, on a nightstand 70. The pad 12 is typically located between a mattress 60 and a box spring 62 of a bed 50. Each pad 12 is capable of sufficient vibration to wake a sleeping person. Each speaker 16 or other auditory emission mechanism is capable of sufficient volume to wake a sleeper.

Figure 4:
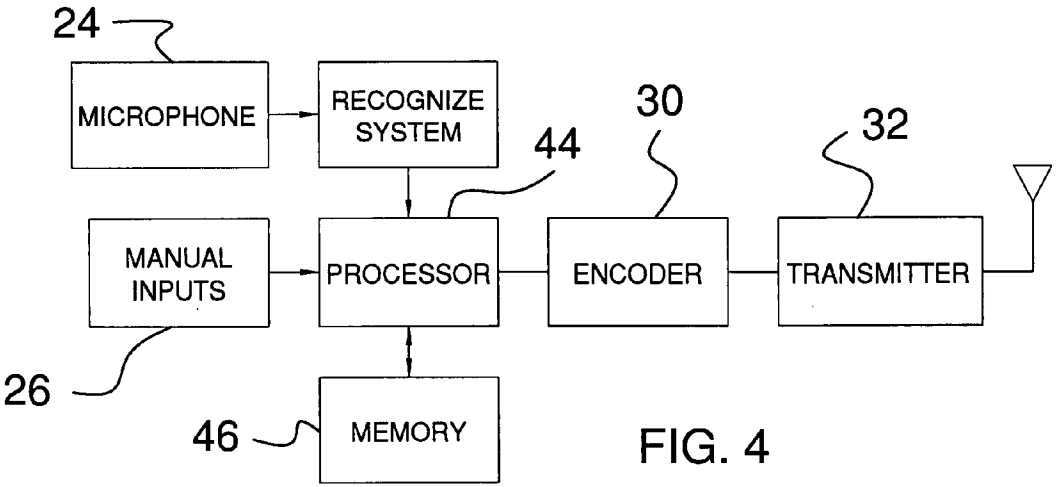
FIG. 4 is a schematic block diagram of the circuitry of the remote control of the invention.

Referring to FIG. 3, the remote control 22 further comprises a microphone 24. The microphone 24 provides for user auditory input to each pad 12 and hence each auditory emission mechanism, such as a speaker 16. The manual input 26 is tactilely accessible on the remote control 12. The remote control 22 further comprises a transmission button 28 and a transmitter 32 (FIG. 4). Each pad 12 and accompanying auditory emission mechanism, such as a speaker 16, is controlled by the remote control 22 individually via the manual input 26 of the remote control 22. Each auditory emission mechanism communicates with each pad 12. Radio frequency (RF) is used in the transmission of commands from the remote control 22. The variety of commands provided by the invention 10 include choice of pad 12, choice of vibrators 14 or speaker 16 or both, choice of intensity of vibrators 14, volume of sound from auditory emission mechanisms, and audio input from the microphone 24. The remote control 22 also provides for duration of auditory and vibratory emissions.

Figure 5:
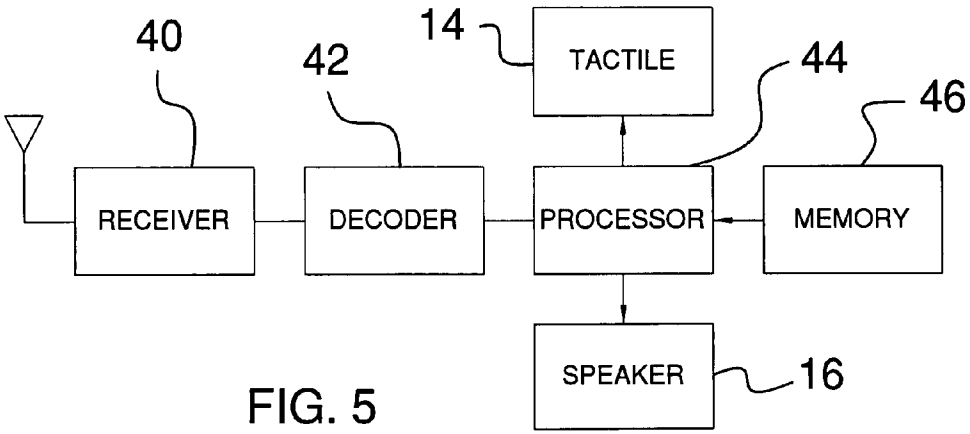
FIG. 5 is a schematic block diagram of the circuitry of the pad of the invention, and communication with accompanying speaker.

Referring to FIG. 5, the circuitry within each pad 12 comprises an RF receiver 40. The decoder disposed within each pad 12 communicates with the receiver 40. The processor within each pad 12 communicates with the decoder 44. The processor 44 further comprises a memory 46. The tactile vibratory media communicates with the processor 44. The auditory emission mechanism, with speaker 16 as example, communicates with the processor 44. A power generator is provided with each receiver 40 and is preferably a battery pack 18.

Referring to FIG. 4, the remote control 22 is in RF communication with every pad 12. The circuitry within each remote control 22 comprises a microphone 24. The transmission button 28 is disposed on the remote control 22.

The manual input 26 is disposed on the remote control 22, wherein each selected pad 122 is controlled by the remote control 22. A processor 44 is in communication with the microphone 24 and the manual input 26. A memory 46 is within the processor 44. The RF transmitter 32 is within the remote control 22. The encoder 30 translates from the processor 44 to the transmitter 32. A powering apparatus (not shown) is provided within the remote control 22. The remote control 22 and the pads 12 do not energize without activation, thereby saving power.

With respect to the above description then, it is to be realized that the optimum dimensional relationships for the parts of the remote controlled awakening device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A remote controlled vibratory and auditory awakening device, in combination, the device comprising:
- a plurality of parallelepiped pads;
- a vibratory media within each pad;
- an auditory emission mechanism communicating with each pad;
- a power generator for each pad;
- an RF receiver accompanying each pad;
- a remote control in RF communication with every pad;
- a microphone disposed in the remote control;
- a manual input on the remote control, wherein each selected pad is controlled by the control;
- a transmission button on the remote control;
- powering apparatus for the remote control.

2. The invention in claim 1 wherein the vibratory media is comprised of a plurality of vibrators.

3. The invention in claim 2 wherein the power generator for the pad is a battery pack.

4. The invention in claim 2 wherein the auditory emission mechanism is at least one speaker.

5. The invention in claim 3 wherein the auditory emission mechanism is at least one speaker.

6. A remote controlled vibratory and auditory awakening device, in combination, the device comprising:
- a plurality of parallelepiped pads;
- a vibratory media within each pad;
- an auditory emission mechanism communicating with each pad;
- a circuitry within each pad, the circuitry comprising:
  - an RF receiver;
  - a decoder communicating with the receiver;
  - a processor communicating with the decoder;
  - a memory within the processor;
- the vibratory media communicating with the processor;
- the auditory emission mechanism communicating with the processor;
- a power generator for each pad circuitry;
- a remote control in RF communication with every pad;
- a circuitry within each remote control, the circuitry comprising:
  - a microphone;
  - a transmission button on the remote control;
  - a manual input on the remote control, wherein each selected pad is controlled by the control;
  - a processor in communication with the microphone and the manual input;
  - a memory within the processor;
  - an RF transmitter;
  - an encoder translating from the processor to the transmitter;
  - a powering apparatus for the remote control.

7. The invention in claim 6 wherein the vibratory media is comprised of a plurality of vibrators.

8. The invention in claim 6 wherein the power generator for the pad is a battery pack.

9. The invention in claim 6 wherein the auditory emission mechanism is at least one speaker.

10. The invention in claim 7 wherein the auditory emission mechanism is at least one speaker.

11. The invention in claim 8 wherein the auditory emission mechanism is at least one speaker.

* * * * *